United States Patent [19]

Dean et al.

[11] 4,442,760

[45] Apr. 17, 1984

[54] FLOW SPLITTING ARRANGEMENT FOR AIR CONDITIONING TERMINAL UNITS

[75] Inventors: Raymond H. Dean; Ghassan Bader, both of Johnson County, Kans.

[73] Assignee: Tempmaster Corporation, Kansas City, Mo.

[21] Appl. No.: 431,364

[22] Filed: Sep. 30, 1982

[51] Int. Cl.[3] ..... F24F 13/08

[52] U.S. Cl. ..... 98/40 D; 98/41 R

[58] Field of Search ..... 236/49; 98/40 D, 40 C, 98/41 R

[56] References Cited

U.S. PATENT DOCUMENTS

| | | | |
|---|---|---|---|
| 3,227,063 | 1/1966 | Lambert | 98/40 D |
| 3,295,432 | 1/1967 | Palmquist | 98/41 R X |
| 3,673,945 | 7/1972 | Rachlin et al. | 98/40 D |
| 3,748,998 | 7/1973 | Lambert | 98/40 D |
| 3,757,667 | 9/1973 | Lambert | 98/40 D |
| 3,760,709 | 9/1973 | Rachlin et al. | 98/40 D |
| 3,918,354 | 11/1975 | Lambert | 98/40 D |
| 4,276,817 | 7/1981 | Meckler | 98/40 D X |

*Primary Examiner*—William E. Tapolcai

*Attorney, Agent, or Firm*—Kokjer, Kircher, Bradley, Wharton, Bowman & Johnson

[57] ABSTRACT

An air conditioning terminal unit for directing heated or cooled air into a room. A duct which receives the air has two outlets which direct the air into an underlying plenum. The air in the plenum is discharged into the room through an air diffuser having two slots which diffuse the air to opposite sides of the terminal unit. Partitions and baffles in the plenum split the air flow and direct the conditioned air in a pattern carrying all of the air from one duct outlet to one of the diffuser slots and all of the air from the other duct outlet to the other diffuser slot. The duct outlets are individually controlled to vary the throw to opposite sides of the diffuser.

6 Claims, 3 Drawing Figures

10
12
14
16
18
18a
20
20a
22
25
26
28
30
32
36
42
44
46
60
62
64
66
78
78a
82
84
98
2.

10
12
14
16a
18
20
20a
30
32
34
40
42
44
46
48
50
52
54
56
58
62
66
68
70
72
74
76
78
80
80a
82
84
84a
84b
84c
84d
84e
86
86a
86b
88
90
92
94
96
3.

26
70
84a
86a
92
92a
94
94a
96

FLOW SPLITTING ARRANGEMENT FOR AIR CONDITIONING TERMINAL UNITS

BACKGROUND AND SUMMARY OF THE INVENTION

This invention relates in general to the field of air distribution systems and more particularly to an air conditioning terminal unit that is constructed to diffuse conditioned air in opposite directions from an air diffuser.

Office buildings and other relative large buildings are heated and cooled by passing conditioned air through ventilation ducts that lead throughout the building. Typically, each office or other area of the building has one or more outlets through which the conditioned air enters the area. A common arrangement involves the mounting of a terminal unit above a false ceiling of the room. The terminal unit has an air diffuser which diffuses the air into the room through an outlet slot built into the false ceiling.

Each separate area of the building usually has individual temperature control which is achieved by controlling the volume of air flow through the ductwork or through the diffuser slot. Systems of this general type have achieved wide popularity due in large part to their high efficiency, low cost and overall simplicity. Cost and performance benefits result from the use of a single large heating or cooling unit for supplying a number of separate areas within the building. At the same time, individual temperature control is provided for each office or other area.

U.S. Pat. Nos. 4,312,475 and 4,331,291 disclose terminal systems that control the discharge of conditioned air by inflating and deflating air bladders which control outlets from the ventilating ducts. The condition of each bladder is in turned controlled by a pneumatic circuit that includes a feedback arrangement sensitive to the velocity of the discharging air. This type of terminal unit is highly effective in many installations because the air flow is virtually independent of the main supply pressure in the ventilating ducts. Also, accurate flow control is provided and there is no need for large pressure differentials in the system.

As previously mentioned, conventional terminal units often have an air diffuser which diffuses air into the room that is to be heated or cooled. Ordinarily, the air diffuser discharges the conditioned air in a single direction, typically downwardly along an exterior wall or window. In a situation where it is desirable to direct the conditioned air primarily to one side of the terminal unit, or more to one side than to the other side, conventional air diffusers of this type are unsatisfactory because they are capable of discharging the air in only a single predetermined pattern. For example, if there are significant heat losses through a window or exterior wall, it may be desirable to direct more heated air toward the window or wall and less toward the interior part of the room. Conventional air diffusers are unable to counteract the heat losses by splitting the air flow in this fashion, and they are thus lacking somewhat in versatility and flexibility.

The present invention is directed to an improved air conditioning terminal unit and has, as its primary goal, the provision of an air diffuser that is capable of splitting the air flow and diffusing it to opposite sides of the unit.

More specifically, it is an object of the invention to provide a terminal unit having a double slot air diffuser in which conditioned air flows in opposite directions from the two slots.

Another object of the invention is to provide a terminal unit wherein the flow through each diffuser slot is individually controlled independently of the other slot. If conditions so warrant, one of the diffuser slots can be made to discharge more conditioned air than the other slot, thus directing more air to one side of the unit than to the other side.

A further object of the invention is to provide a terminal unit of the character described in which the discharge of conditioned air through each diffuser slot is uniform along the entire length of the diffuser.

An additional object of the invention is to provide a terminal unit of the character described wherein each of the diffuser slots receives air from a different outlet in the ductwork.

Yet another object of the invention is to provide a terminal unit of the character described that is well adapted to be incorporated in conventional duct work.

A still further object of the invention is to provide a terminal unit of the character described which is simple and economical to construct and install.

In accordance with the invention, these and other objects are achieved in an improved air conditioning terminal unit. A uniquely partitioned plenum receives the conditioned air that is discharged through a pair of outlets in a ventilating duct. A double slot air diffuser is connected with the plenum and provides two side by side fuser slots which throw to opposite sides of the diffuser. Partitions in the plenum cooperate with a special baffle arrangement to direct all of the air from one duct outlet to one of the diffuser slots and all of the air from the other duct outlet to the other diffuser slot. Each duct outlet is controlled by its own air bladder and, by properly controlling the bladders, the flow of conditioned air can be split as desired between the two diffuser slots. Consequently, the flow of conditioned air to each side of the terminal unit can be adjusted in accordance with the heating or cooling requirements. Each diffuser slot is equipped with a perforated plate which equalizes the flow along the length of the slot.

DETAILED DESCRIPTION OF THE INVENTION

In the accompanying drawing which forms a part of the specification and is to be read in conjunction therewith and in which like reference numerals are used to indicate like parts in the various views.

Figure 1:
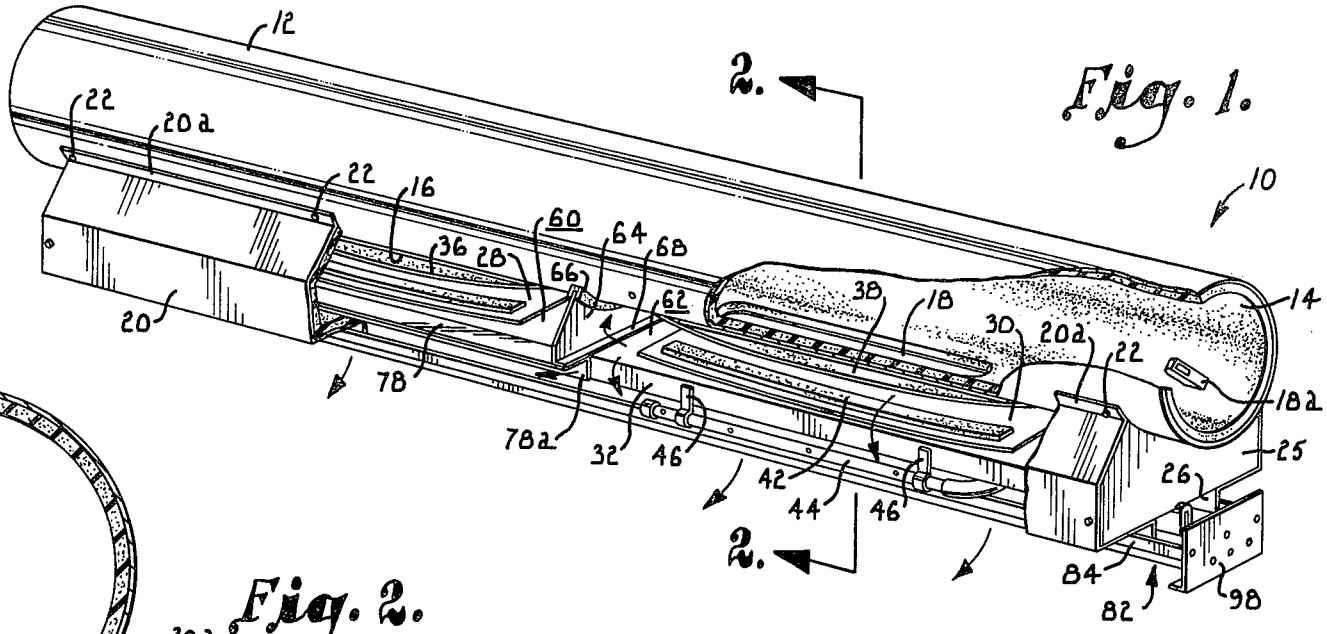
FIG. 1 is a perspective view of an air conditioning terminal unit constructed according to a preferred embodiment of the present invention, with portions broken away for purposes of illustration.

Referring to the drawing in detail, numeral 10 generally designates an air conditioning terminal unit constructed in accordance with the present invention. The terminal unit 10 includes a cylindrical duct 12 which can be added to or incorporated into the ventilating ductwork (not shown) of a building. A large heating or cooling unit provides heated or cooled air to the ductwork, and a fan forces the conditioned air through the duct work, including the duct 12.

The inside surface of duct 12 is lined with an acoustical foam lining 14 which serves to attenuate noise in the duct. The bottom portion of duct 12 is provided with a pair of outlet slots 16 and 18 which are spaced apart from one another lengthwise of the duct. The slots 16 and 18 are located on opposite sides of the center of the duct. The conditioned air is supplied to duct 12 at a relatively high supply pressure and is discharged from the duct at a relatively low pressure through slots 16 and 18. Pressure sensors 16*a* and 18*a* are mounted in duct 12 near the respective slots 16 and 18 to sense the main supply pressure in the duct.

A sheet metal plenum 20 is secured to the underside of duct 12 to receive the air that is discharged from the duct through slots 16 and 18. The plenum 20 has flanges 20*a* on the upper edges of its opposite sides, and the flanges 20*a* are secured to duct 12 by suitable fasteners 22 (see FIG. 1). The interior surfaces of plenum 20 are provided with an acoustical foam lining 24 which attenuates noise. The plenum 20 has opposite end panels 25 which close its opposite ends. Centered on the bottom of plenum 20 is an elongate outlet 26 (FIG. 2) through which the conditioned air is discharged from the plenum. The outlet 26 extends the entire length of the plenum.

The flow of air into plenum 20 through slots 16 and 18 is controlled by respective air bladders 28 and 30. The bladders 28 and 30 underlie the respective slots 16 and 18 and are supported on top of a metal pan 32 which is filled with acoustical material 34. Pan 32 extends horizontally within plenum 20 between the opposite end panels 25. Overlying bladders 28 and 30 are respective rubber pads 36 and 38 which are secured to the bottom of duct 12 at their opposite ends. Pad 36 underlies slot 16, and the other pad 38 underlies slot 18. When the air bladders are in the deflated condition, the rubber pads sag downwardly away from the duct outlet slots 16 and 18, and the outlet slots are then open such that the conditioned air can flow freely through them into the plenum 20. Conversely, when the air bladders are inflated, the pads are raised and pressed against slots 16 and 18 to close them off. The side edges of each slot 16 and 18 are provided with porous foam strips 40 (see FIG. 2) against which the pads 36 and 38 are pressed when raised to the closed position. The side edges of bladders 28 and 30 are provided with porous foam strips 42 which are pressed tightly against strips 40 when the bladders are fully inflated to close off the duct slots 16 and 18.

Each of the bladders 28 and 30 is controlled by a pneumatic control circuit of the type shown in U.S. Pat. No. 4,312,475 to Edwards et al, which is incorporated herein by reference. The pneumatic control circuits for the two bladders are independent of one another and are independently adjustable so that the inflation and deflation of each bladder is individually controlled independently of the condition of the other bladder. The velocity sensor associated with bladder 28 is in the form of an elongate, perforated tube 44 attached to one side of pan 32 by a pair of brackets 46. The velocity sensor for the other bladder 30 is likewise an elongate, perforated tube 48. Tube 48 is connected by brackets 50 to the opposite side of pan 32. Tubes 44 and 48 each extend half the length of the terminal unit. Air is supplied to and exhausted from each bladder through a fitting, one of which is designated by numeral 52 in FIG. 2. An air line such as that indicated at 54 connects with each of the fittings.

The plenum 20 is separated by pan 32 into an upper plenum chamber 56 located above the top surface of the pan and a lower plenum chamber 58 located below the pan. The upper plenum chamber 56 is in turn divided into a pair of compartments 60 and 62 by a transverse partition plate 64. Plate 64 extends within plenum 20 between duct 12 and pan 32 and between the opposite sides of the plenum. A curved pad 66 is secured to the upper edge of partition 64 to cushion its contact with the curved lower surface of duct 12. The lower edge of partition 64 has a flange 68 which is secured to the top surface of pan 32 in order to maintain the partition 64 in place. The partition is located halfway along the length of duct 12 and extends transversely across the entire width of plenum 20 between slots 16 and 18. The upper compartments 60 and 62 are thus arranged end to end, and each compartment extends one half the length of the plenum completely across its width. Partition 64 isolates slots 16 and 18 from one another such that all of the air passing through slot 16 enters compartment 60, and all of the air discharging through slot 18 enters compartment 62.

Figure 2:
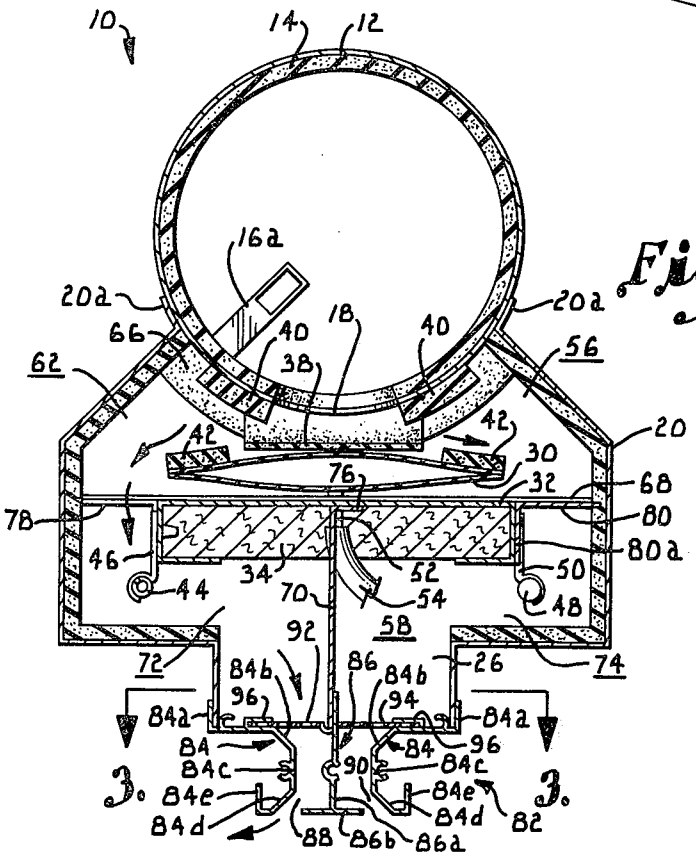
FIG. 2 is a sectional view on an enlarged scale taken generally along line 2—2 of FIG. 1 in the direction of the arrows.

The lower plenum chamber 58 is divided by a longitudinal partition 70 into a pair of side by side compartments 72 and 74 (see FIG. 2 in particular). Partition 70 has a vertical orientation and extends the entire length of plenum 20 between the end panels 25. The upper edge of partition 70 has a flange 76 which is secured to pan 32 in order to maintain the partition in place. Partition 70 is located halfway across the width of the lower plenum chamber 58, and the two lower compartments 72 and 74 are thus equal in size and are arranged side by side along the entire length of the plenum. The partition 70 extends downwardly through the plenum outlet 26.

The flow of conditioned air between the upper and lower plenum chambers 56 and 58 is controlled by a pair of baffles 78 (FIG. 1) and 80 (FIG. 2). Baffle 78 has a down turned flange 78*a* which is secured to one side of pan 34, and the other baffle 80 has a similar downturned flange 80*a* which is secured to the opposite side of the pan. Baffle 78 extends between pan 32 and one plenum side wall, and extends lengthwise half the length of the plenum between partition 64 and one end panel 25 of the plenum. Baffle 78 blanks off one side of upper plenum compartment 60 to isolate compartment 60 from lower compartment 72. The opposite side of pan 32 is left open such that compartment 60 communicates with compartment 74 in the lower plenum chamber. Thus, all of the conditioned air in compartment 60 flows into compartment 74.

The other baffle 80 is located on the opposite side of pan 32 from baffle 78 and extends between partition 64 and the opposite end panel 25 of the plenum. Baffle 80 thus blanks off the space on one side of pan 32 to isolate upper plenum compartment 62 from lower plenum compartment 74. However, the opposite side of pan 32 is left open to provide communication between upper plenum compartment 62 and lower compartment 72. All of the air entering compartment 62 is thus directed into compartment 72, as indicated by the directional arrows in FIG. 2.

Mounted to the plenum outlet 26 is a double slot air diffuser generally designated by numeral 82. The air diffuser 82 extends the entire length of the plenum and includes opposite sides 84 having flanges 84*a* on their upper edges secured to the lower edge portions of the outlet 26. Each side 84 of the diffuser has a wall portion 84*b* that extends inwardly and downwardly, a vertical wall portion 84*c*, and a wall portion 84*d* that angles downwardly and outwardly from the bottom of portion 84*c*. An upturned flange 84*e* is formed on the bottom of each side 84.

A central partition 86 divides the diffuser 84 into opposite halves which are mirror images of one another. Partition 86 extends the entire length of the diffuser and has a central web portion 86*a* and a flange 86*b* on the bottom. The diffuser 82 provides a pair of diffuser slots 88 and 90 on opposite sides of partition 86. The upper end of partition 86 is secured to the lower end of partition 70. Accordingly, slot 88 communicates only with plenum chamber 72, while the other slot 90 communicates only with chamber 74. The diffuser slots 88 and 90 throw generally to opposite sides of the terminal unit and downwardly somewhat.

Figure 3:
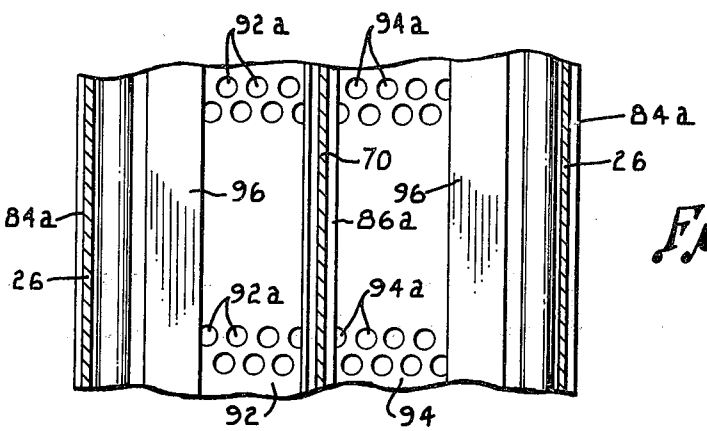
FIG. 3 is a sectional view on an enlarged scale taken generally along line 3—3 of FIG. 2 in the direction of the arrows.

A pair of perforated plates 92 and 94 are interposed between outlet 26 and the diffuser slots 88 and 90, respectively. Plates 92 and 94 extend the entire length of the diffuser 82 and are held in place by tabs 96 formed on the sides 84 of the diffuser. Plates 92 and 94 have small perforations 92*a* and 94*a* (FIG. 3). Plate 92 covers the passage between compartment 72 and slot 88, and the other plate 94 covers the passage between compartment 74 and slot 90. Consequently, all of the conditioned air passes through the perforated plates 92 and 94 before reaching the diffuser 82. The opposite ends of diffuser 82 are covered by end plates 98.

In operation of the terminal unit 10, conditioned air (heated or cooled) is supplied at a relatively high main supply pressure to duct 12. If either or both of the outlet slots 16 and 18 are open, the conditioned air discharges through the open slot or slots and into the underlying plenum 20. All of the air passing through slot 16 enters upper plenum compartment 60 and is prevented by partition 64 from entering the other upper plenum compartment 62. In a similar manner, partition 64 assures that all of the conditioned air passing through slot 18 is directed into compartment 62 and blocked from compartment 60.

The air in compartment 60 is directed into lower plenum compartment 74 since baffle 78 prevents it from entering the other compartment 72. Once the conditioned air has entered compartment 74, partition 70 prevents it from crossing over into compartment 72. Similarly, all of the conditioned air in compartment 62 is directed into compartment 72 and is prevented by baffle 80 and partition 70 from entering compartment 74. In this manner, the baffles and partitions direct all of the air passing through slot 16 into compartment 74 and then into the room through plate 94 and diffuser slot 90. All of the air passing through slot 18 is directed into compartment 72 and then through plate 92 and the other diffuser slot 88, as shown by the directional arrows in FIG. 2.

Since the flow through each outlet slot 16 and 18 is individually and independently controlled, more conditioned air can be directed to one side of the terminal unit than to the other side by inflating one bladder 28 or 30 to a greater extent than the other bladder. Thus, if slot 16 is closed to a greater extent than slot 18, more conditioned air is directed through diffuser slot 88 than through slot 90, and the heating or cooling effect on one side of the terminal unit is greater than on the other side. One of the duct outlets can be closed off completely while the other remains open, and in this case, conditioned air is directed only to one side of the terminal unit. The flow can be split in any other desired manner by properly controlling the inflation of the bladders 28 and 30.

Since each bladder 28 and 30 has its own pneumatic control circuit which is individually controlled, the bladders are independently controlled. The velocity sensor tubes 44 and 48 are strategically located directly in the path of the air flowing from the upper plenum chamber 56 to the lower plenum chamber 58 in order to accurately sense theflow velocity. The supply pressure sensors 16*a* and 18*a* in duct 12 are similarly located to sense the pressure conditions adjacent to the slots 16 and 18.

The perforated plates 92 and 94 increase the pressure levels in the lower plenum compartments 72 and 74 and equalize the flow along the entire length of each diffuser slot 88 and 90. It is noted that all of the conditioned air that enters the lower plenum compartments 72 and 74 initially flows into only one half the length of the compartment. The air then passes beneath the baffle into the other half of the compartment. The flow restriction provided by the perforated plates 92 and 94 assures that before discharging through the diffuser, the air is distributed substantially uniformily along the diffuser length. Thus, the conditioned air passing through each slot 88 and 90 is distributed uniformly along the length of the slot.

The configuration of the air diffuser 82 can be varied as desired. The two diffuser slots 88 and 90 can be made to throw in directions other than those shown in FIG. 2, although it is contemplated that slots will in any event have opposite throw directions. It is also to be understood that the terminal unit can throw generally upwardly from a soffit or the like rather downwardly from the false ceiling of a room.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. A terminal unit for an air distribution system, said terminal unit comprising:

a duct for receiving a supply of conditioned air, said duct having first and second outlets spaced apart from one another along the length of the duct for discharging conditioned air therefrom;

flow control means for controlling the flow through said first and second outlets;

a plenum connected with said duct, said plenum presenting an upper plenum chamber communicating with said outlets to receive conditioned air therefrom and a lower plenum chamber below the upper chamber;

a transverse partition in said upper plenum chamber between said first and second outlets, said transverse partition dividing said upper plenum chamber into first and second compartments communicating with the respective first and second outlets, said compartments being arranged generally end to end and each extending substantially the entire width of the upper plenum chamber;

a longitudinal partition in said lower plenum chamber dividing same into third and fourth compartments arranged generally side by side and each extending substantially the entire length of the lower plenum chamber;

baffle means between the upper and lower plenum chambers for directing the conditioned air in said first compartment into said third compartment and the conditioned air in said second compartment into said fourth compartment; and an air diffuser having a first diffuser slot communicating with said third compartment to discharge the conditioned air therefrom and a second diffuser slot communicating with said fourth compartment to discharge the conditioned air therefrom, said diffuser slots extending generally side by side substantially the entire length of the plenum and arranged to direct the air passing therethrough to opposite sides of the air diffuser.

2. The invention of claim 1, including a perforated plate associated with each diffuser slot at a location to receive the air flowing toward the slot, said perforated plates acting to equalize the flow along the lengths of the diffuser slots.

3. The invention of claim 1, including a pair of perforated plates in said air diffuser for equalizing the flow along the lengths of the diffuser slots, one of said perforated plates being disposed between said third compartment and said first diffuser slot and the other perforated plate being disposed between said fourth compartment and said second diffuser slot.

4. The invention of claim 1, wherein said baffle means includes:

a first baffle between said upper and lower plenum chambers at a location to block flow from said first compartment to said fourth compartment; and a second baffle between said upper and lower plenum chambers at a location to block flow from said second compartment to said third compartment.

5. The invention of claim 1, wherein said flow control means includes means for controlling the flow through each outlet independently of the other outlet.

6. The invention of claim 1, wherein said flow control means includes:

first and second bladders associated with the respective first and second outlets, said bladders being inflatable to block the corresponding outlets and being deflatable to open the corresponding outlets; and means for effecting inflation and deflation of each bladder independently of the other bladder.

* * * * *